US009368242B2

(12) United States Patent
Eun et al.

(10) Patent No.: US 9,368,242 B2
(45) Date of Patent: Jun. 14, 2016

(54) APPARATUS AND METHOD FOR SEPARATING RADIOACTIVE NUCLIDES AND RECOVERING REFINED SALT FROM LICL WASTE SALT OR LICL-KCI EUTECTIC WASTE SALT

(71) Applicant: Korea Atomic Energy Research Institute, Daejeon (KR)

(72) Inventors: Hee-Chul Eun, Daejeon (KR); Yung-Zun Cho, Daejeon (KR); Jung Hoon Choi, Daejeon (KR); Hwan Seo Park, Daejeon (KR); Hee-Chul Yang, Daejeon (KR); JunHong Kim, Gyeongsansi (KR); Tae-Kyo Lee, Pohang-si (KR); Geun-il Park, Daejeon (KR)

(73) Assignee: Korea Atomic Energy Research Institute, Daejeon (KR)

( * ) Notice: Subject to any disclaimer, the term of this patent is extended or adjusted under 35 U.S.C. 154(b) by 461 days.

(21) Appl. No.: 14/141,993

(22) Filed: Dec. 27, 2013

(65) Prior Publication Data

US 2014/0374653 A1 Dec. 25, 2014

(30) Foreign Application Priority Data

Jun. 21, 2013 (KR) ..... 10-2013-0071776

(51) Int. Cl.
*G21F 9/30* (2006.01)
*G21F 9/32* (2006.01)

(52) U.S. Cl.
CPC .... *G21F 9/30* (2013.01); *G21F 9/32* (2013.01)

(58) Field of Classification Search
None
See application file for complete search history.

(56) References Cited

U.S. PATENT DOCUMENTS

H001227 H * 9/1993 Lewis ..... G21F 9/162 210/679
5,264,159 A * 11/1993 Ikeda ..... G21F 9/305 588/20
5,340,506 A * 8/1994 Koyama ..... G21F 9/302 210/682

(Continued)

FOREIGN PATENT DOCUMENTS

| | | | |
|---|---|---|---|
| JP | 10-232298 | A | 9/1998 |
| JP | 2004-101270 | A | 4/2004 |
| KR | 10-0861262 | B1 | 10/2008 |
| KR | 10-2012-0021568 | A | 3/2012 |
| KR | 10-1137436 | B1 | 4/2012 |

OTHER PUBLICATIONS

C. L Yaws, Handbook of Vapor Pressure, vol. 4, Inorganic Compounds and Elements, Gulf Publishing, Houston, Texas, USA, 1995, p. 360.

(Continued)

*Primary Examiner* — Joseph D Anthony
(74) *Attorney, Agent, or Firm* — Knobbe Martens Olson & Bear, LLP

(57) ABSTRACT

There are provided an apparatus and method for separating radioactive nuclides from a waste salt and recovering a refined salt, which are able to maximize process efficiency and operating efficiency of a process of regenerating a waste salt produced during a pyrochemical process of used nuclear fuel by converting the waste salt into a thermally stable form and distilling the waste salt under a reduced pressure using a single apparatus having two top covers which are mountable to replace radioactive nuclides included in the waste salt, and highly improve applicability and utility in a remote operation facility for disposal of a radioactive waste by further simplifying operation/handling compared with conventional processes.

8 Claims, 4 Drawing Sheets

(56) References Cited

U.S. PATENT DOCUMENTS

| | | | | |
|---|---|---|---|---|
| 7,875,760 | B2 * | 1/2011 | Cho | C25C 3/34 423/11 |
| 2009/0005628 | A1 * | 1/2009 | Cho | G21F 9/06 588/18 |

OTHER PUBLICATIONS

Notice of Allowance dated Dec. 9, 2014 of corresponding Korean Patent Application No. Oct. 2013-0071776—3 pages.

* cited by examiner

APPARATUS AND METHOD FOR SEPARATING RADIOACTIVE NUCLIDES AND RECOVERING REFINED SALT FROM LICL WASTE SALT OR LICL-KCI EUTECTIC WASTE SALT

CROSS-REFERENCE TO RELATED APPLICATION

This application claims priority to and the benefit of Korean Patent Application No. 2013-0071776, filed on Jun. 21, 2013, the disclosure of which is incorporated herein by reference in its entirety.

BACKGROUND

1. Field of the Invention

The present invention relates to an apparatus and method for separating radioactive nuclides in a waste salt and recovering a refined salt from the waste salt, which are able to maximize process efficiency and operating efficiency of a process of regenerating a waste salt generated from a pyrochemical process of used nuclear fuel by converting radioactive nuclides in the waste salt into a thermally stable form and distilling the waste salt under a reduced pressure using a single apparatus having two top covers which are mountable for converting radioactive nuclides or distillation a waste salt, and highly improve applicability and utility in a remote operation facility for the waste salt treatment by further simplifying operation/handling compared with conventional processes.

2. Discussion of Related Art

Rare earth nuclides in a LiCl—KCl eutectic salt generated from a pyrochemical process of used nuclear fuel is converted into an insoluble compound and precipitated to the bottom of the eutectic salt, the eutectic salt containing the insoluble compound is divided into an upper refined salt and a precipitate layer, and rare earth nuclides and refined salt are recovered from the precipitate layer using technology of regenerating a LiCl—KCl eutectic waste salt, which was developed from a combination of an oxidative (or phosphorylative) precipitation process and a vacuum distillation process.

Such technology of regenerating a eutectic waste salt has been evaluated as world-leading technology in the process of disposing of a eutectic waste salt since it is used to separate at least 99% of the rare-earth nuclides and recover at least 95% of the eutectic salt.

However, such conventional technology of regenerating a eutectic waste salt is specifically divided into four processes: a chemical conversion and precipitation process, a process of separating a solid eutectic salt, a process of separating a precipitate layer, and a process of distilling a eutectic salt in a precipitate layer. Since the same number of apparatuses are required to perform the processes, operations of the apparatuses for performing the processes cause an increase in operating time and cost of equipment, which results in a decrease in operating efficiency.

Also, a process of separating a solid eutectic salt includes separating a solid salt in a reaction container, to which the eutectic salt in a solid state discharged after being subjected to a chemical conversion and precipitation process and being cooled at room temperature is stuck, by heating an outer wall of the reaction container using an electric heater in a state in which the reaction container is turned upside down. In this separation process, upper and lower portions of the solid salt are separated as a precipitate layer and a refined salt layer, respectively, in the reaction container. In such a process of separating a solid eutectic salt, the eutectic salt present in the precipitate layer may intermittently flow down and contaminate the lower refined salt layer. In this case, since it is difficult to separate the refined salt layer and the precipitate layer, the separated salt should often be repeatedly processed.

Meanwhile, since a refined salt layer and a precipitate layer including a rare-earth compound are separated by cutting the top of the precipitate layer using an electric cutter in the case of a process of separating a solid eutectic salt discharged in the process of separating a solid eutectic salt into a refined salt layer and a precipitate layer, fine salt particles may be scattered, and salt debris may be precipitated. Therefore, an additional apparatus for collecting and recovering these salts is required. Also, when the separated precipitate layer and refined salt layer are subjected to a process considering remote operations from facilities handling a radioactive material in a cylindrical shape, the precipitate layer and the refined salt layer may not be easily handled during a transfer process.

Also, the loss of salts may occur during the process of separating a solid eutectic salt and the process of separating a precipitate layer, thereby causing a decrease in salt recovery ratio. As the loss of salts is accumulated, the problems regarding operations of the apparatus and an increase in amount of waste to be further disposed may be caused.

Patent document: Korean Patent Publication No. 2012-0021568, Korean Registered Patent No. 0861262

SUMMARY OF THE INVENTION

The present invention is directed to an apparatus and method for separating radioactive nuclides in a waste salt and recovering a refined salt from the waste salt, which are able to separate radioactive nuclides in a waste salt and recover most of the salts in the form of a pure renewable refined salt by converting the radioactive nuclides in the waste salt into a thermally stable form and distilling the waste salt under a reduced pressure, using a single reaction/distillation apparatus having two replaceably mountable top covers.

Also, the present invention is directed to an apparatus and method for separating radioactive nuclides in a waste salt and recovering a refined salt from the waste salt, which are able to reduce the operating time and the cost of equipment by simplifying apparatuses and processes to perform conventional processes for separating radioactive nuclides from a waste salt and recovering a refined salt (two processes on LiCl waste salt in two apparatuses/four processes on LiCl—KCl eutectic waste salt in four apparatuses) in two processes in a single apparatus, maximize process efficiency and operating efficiency of a process of regenerating a waste salt produced from a pyrochemical process of used nuclear fuel by enhancing purity of salts recovered with no loss of the salts or contamination of the refined salt, which are problematic in the conventional processes, and highly improve applicability and utility in a remote operation facility for disposal of a radioactive waste by further simplifying operation/handling, compared with the conventional processes.

According to an aspect of the present invention, there is provided a method of separating radioactive nuclides from a waste salt and recovering a refined salt, which includes a first operation of agitating radioactive nuclides in the waste salt and a chemical additive by installing a first top cover provided with a stirrer in a reaction/distillation apparatus and rotating the stirrer, and converting the radioactive nuclides in the waste salt into an insoluble compound in the waste salt, and a second operation of detaching the first top cover provided with the stirrer from the reaction/distillation apparatus, replaceably mounting a second top cover provided with a heater in the reaction/distillation apparatus, distilling the waste salt under a reduced pressure to separate the radioactive nuclides, and recovering a renewable refined salt when a chemical conversion reaction in the first operation is completed.

Here, the radioactive nuclides included in the waste salt in the first operation may be dissolved in the form of a chloride, and may be converted into a thermally stable form by reaction with the chemical additive introduced into the waste salt.

In this case, a reaction temperature required to convert the radioactive nuclides in the waste salt into the thermally stable form may be set within a temperature range in which the waste salt is able to be present in a molten state.

Also, the agitating of the radioactive nuclides in the waste salt and the chemical additive using the stirrer may be performed at 300 rpm for at least one hour.

In addition, when a chemical conversion reaction in the first operation is completed, the stirrer may be lifted upward, and the reaction container storing the waste salt may be cooled to a temperature of 200° C. or less prior to replacing the first top cover with the second top cover.

Here, the distilling of the waste salt under a reduced pressure in the second operation may include (a) decompressing an inner part of the reaction/distillation apparatus to a predetermined pressure using a decompression device while heating a vaporization chamber in the reaction/distillation apparatus to a predetermined temperature at which the waste salt is not volatilized, (b) closing a valve of the decompression device in a state in which the inner part of the reaction/distillation apparatus remains decompressed to a predetermined pressure, suspending an operation of the decompression device, and producing conditions for closed systems under a reduced pressure, and (c) heating the vaporization chamber to a temperature at which the waste salt is able to be smoothly volatilized, heating the condensation chamber to a temperature lower than that of the vaporization chamber, and distilling the waste salt under a reduced pressure by means of a temperature gradient formed between the vaporization chamber and the condensation chamber.

In this case, the decompressing of the inner part of the reaction/distillation apparatus in operation (a) may be performed at a pressure of 0.005 Torr or less.

In addition, the vaporization chamber in operation (c) may be heated to a temperature of 850° C. or higher, and the condensation chamber may be heated to a temperature of 700° C.

Additionally, the bottom of the recovery container in which the refined salt produced in the vacuum distillation process in operation (c) is recovered may be maintained at a temperature of 50° C. or lower to facilitate separation of the recovered salt deposited in the recovery container.

According to another aspect of the present invention, there is provided an apparatus for separating radioactive nuclides from a waste salt and recovering a refined salt, which includes a vaporization chamber having a reaction container installed therein for accommodating a waste salt, a first top cover provided with a stirrer configured to agitate the waste salt accommodated in the reaction container of the vaporization chamber, a second top cover provided with a first electric heater configured to distill the waste salt under a reduced pressure and mutually replaceable with the first top cover provided with the stirrer when a chemical conversion reaction of the waste salt using the stirrer is completed, a condensation chamber in which salt steam produced by heating the vaporization chamber is condensed and liquefied, a decompression device configured to decompress inner parts of the vaporization chamber and the condensation chamber to a predetermined pressure, a recovery container which is disposed at the bottom of the condensation chamber and in which the salt steam liquefied at the condensation chamber precipitates by gravity to be recovered in the form of a refined salt, and a bottom cover switchably installed at the bottom of the condensation chamber to unload the recovery container.

Here, a baffle coupled to the stirrer may be installed to be adjacent to an inner wall of the reaction container.

Also, the apparatus for separating radioactive nuclides from a waste salt and recovering a refined salt may further include an upward/downward driving device driven to lift the stirrer and the baffle upward and downward at the same time.

In addition, the apparatus according to the present invention may further include a top cover opening/closing device configured to automatically open and close the first top cover or the second top cover.

Additionally, the apparatus according to the present invention may further include a bottom cover opening/closing device configured to automatically open and close the bottom cover.

Meanwhile, the apparatus for separating radioactive nuclides from a waste salt and recovering a refined salt according to the present invention may further include a second electric heater configured to heat the vaporization chamber, and a third electric heater and a fourth electric heater configured to heat upper and lower portions of the condensation chamber, respectively, wherein the heating by the second electric heater, the third electric heater and the fourth electric heater is controlled in sequentially decreasing temperatures so that a temperature gradient in the vaporization chamber and the condensation chamber is formed to facilitate the flow of salt steam.

In this case, the vaporization chamber may be decompressed to a predetermined pressure by means of the decompression device while the waste salt is heated by the second electric heater to a predetermined temperature at which the waste salt is able to be smoothly volatilized.

Also, a cooling water circulation passage may be formed at the bottom of the recovery container.

BRIEF DESCRIPTION OF THE DRAWINGS

The above and other objects, features and advantages of the present invention will become more apparent to those of ordinary skill in the art by describing in detail exemplary embodiments thereof with reference to the accompanying drawings, in which.

DETAILED DESCRIPTION OF EXEMPLARY EMBODIMENTS

Exemplary embodiments of the present invention will be described in detail below with reference to the accompanying drawings. While the present invention is shown and described in connection with exemplary embodiments thereof, it will be apparent to those skilled in the art that various modifications can be made without departing from the spirit and scope of the invention.

The present invention is directed to an apparatus for separating radioactive nuclides from a waste salt and recovering a refined salt, which is a single reaction/distillation apparatus having two top covers and one bottom cover, the top covers being provided with an impeller which is a waste salt agitating unit and an electric heater which is a waste salt heating unit, wherein the radioactive nuclides are separated and the renewable refined salt is recovered by performing a process of converting the radioactive nuclide in the waste salt into an insoluble compound in the waste salt using the top cover provided with the impeller, followed by distilling the waste salt under a reduced pressure using the top cover provided with the electric heater.

Figure 1:
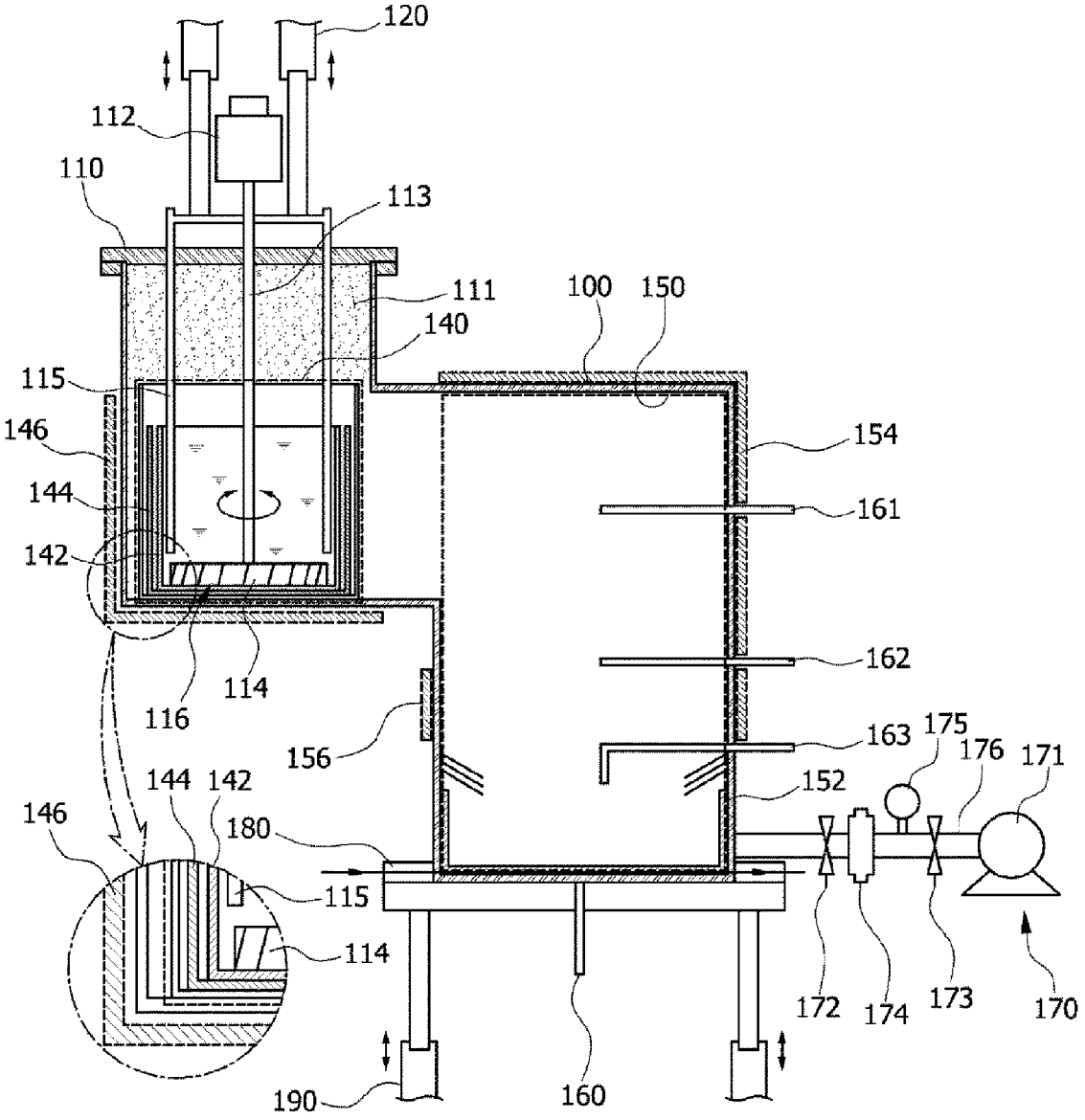
FIGS. 1 and 2 are block diagrams showing an apparatus for separating radioactive nuclides from a waste salt and recovering a refined salt according to one exemplary embodiment of the present invention.
Figure 2:
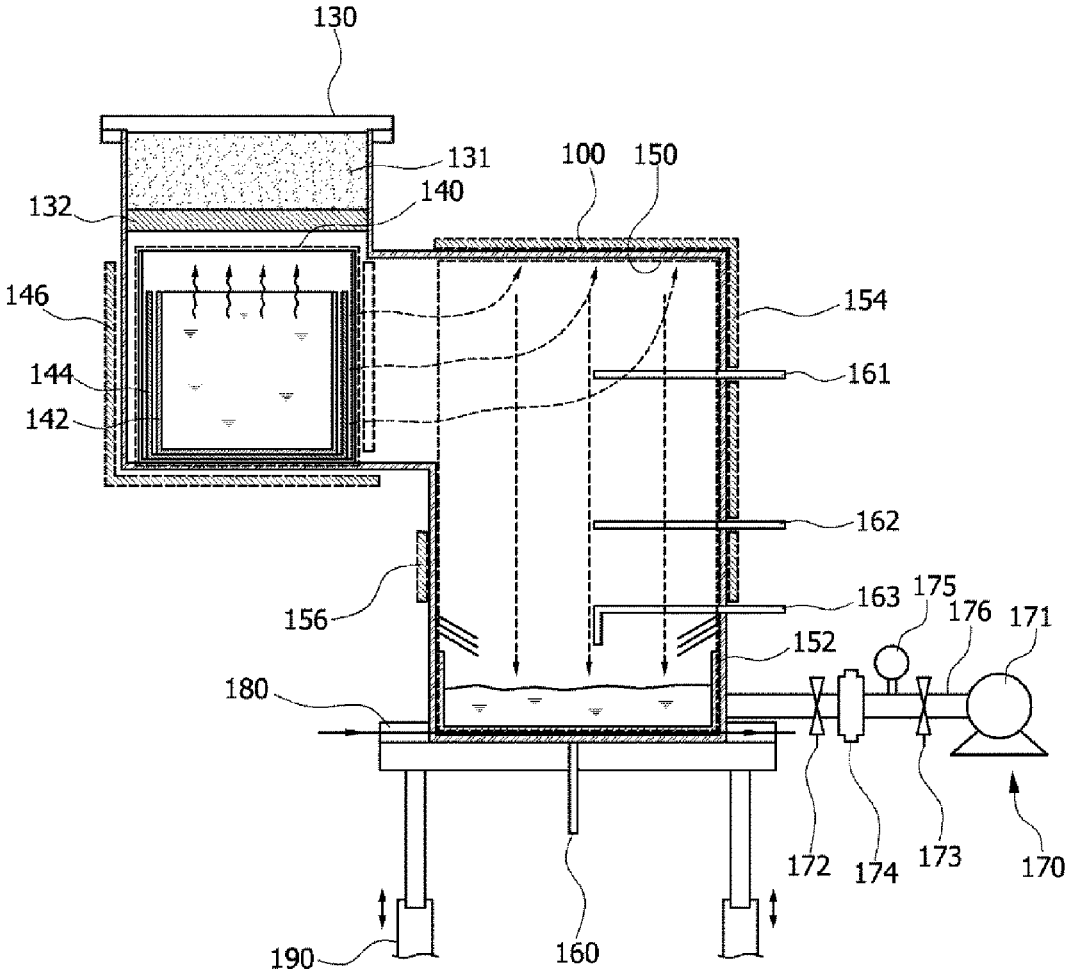

FIGS. 1 and 2 are systemic block diagrams showing a reaction/distillation apparatus for separating radioactive nuclides from a waste salt and recovering a refined salt according to one exemplary embodiment of the present invention. Here, FIG. 1 shows the reaction/distillation apparatus having a first top cover installed therein for performing physical and chemical reactions to convert the radioactive nuclides in the waste salt into an insoluble compound in the waste salt, and FIG. 2 shows that the first top cover shown in FIG. 1 is detached and a second top cover is replaceably mounted in the reaction/distillation apparatus to distill the waste salt under a reduced pressure.

Referring to FIGS. 1 and 2, the apparatus for separating radioactive nuclides from a waste salt and recovering a refined salt according to the present invention has a vaporization region 140 formed therein for vaporizing salts in a reaction/distillation apparatus 100 configured as a single apparatus (a left region indicated by a dotted line, hereinafter referred to as a 'vaporization chamber') and a condensation region 150 formed therein for condensing the salts (a right region indicated by a dotted line, hereinafter referred to as a 'condensation chamber'), and also further includes a decompression device 170 installed to maintain decompression of inner parts of the vaporization chamber 140 and the condensation chamber 150 under a predetermined pressure upon vaporization of the salts.

A reaction container 142 accommodating a waste salt is disposed inside the vaporization chamber 140 in a state in which the reaction container 142 is anchored onto the reaction container holder 144, and a first top cover 110 provided with a stirrer, which is able to agitate a waste salt accommodated in the reaction container 142 disposed inside the vaporization chamber 140, is mounted above the reaction/distillation apparatus 100 in which the vaporization chamber 140 is arranged. Also, a heat insulator 111 is provided at a lower surface of the first top cover 110 to maintain heat insulation upon heating of the vaporization chamber 140.

The stirrer 116 includes a motor 112 disposed above an outer side of the first top cover 110, a shaft 113 coupled to the motor 112, and an impeller coupled to a lower end of the shaft 113. In this case, the shaft 113 coupled to the motor 112 is vertically formed through the first top cover 110, the heat insulator 111 and the vaporization chamber 140 to extend to an inner lower end of the reaction container 142, and an impeller 114 having four pitched blades is coupled to a lower end of the shaft 113. The impeller 114 serves to uniformly mix the waste salt stored in the reaction container 142 while rotating with the shaft 113 upon rotation of the motor 112.

In this case, a baffle 115 having a plurality of through holes (not shown) formed therein for enhancing agitation efficiency upon agitation of the waste salt is installed in the reaction container 142 to be adjacent to an inner wall of the reaction container 142, and such a baffle 115 is installed so that the baffle 115 can be mutually coupled to the stirrer.

Also, when agitation of the waste salt using the stirrer 116 is completed, an upward/downward driving device 120 which is able to be driven in a vertical direction to unload the stirrer 116 and the baffle 115 by lifting the stirrer 116 and the baffle 115 together is installed.

As shown in FIG. 2, a second top cover 130 that is mutually replaceable with the first top cover 110 provided with the stirrer 116 as shown in FIG. 1 to distill a waste salt under a reduced pressure when the agitation of the waste salt using the stirrer 116 is completed is installed at the reaction/distillation apparatus 100 according to the present invention.

Like the above-described first top cover 110, a heat insulator 131 is installed at a lower surface of the second top cover 130, and a first electric heater 132 configured to electrically heat the vaporization chamber 140 is installed under the heat insulator 131. Also, a second electric heater 146 configured to heat an inner part of the vaporization chamber 140 with the first electric heater 132 arranged above the vaporization chamber 140 is installed at the sidewalls and outer bottom portion of the vaporization chamber 140.

Although not shown in the drawings, a top cover opening/closing device may also be further installed to automatically open and close the first top cover 110 and the second top cover 130 from the reaction/distillation apparatus 100.

Meanwhile, salt steam produced by heating the waste salt in the vaporization chamber 140 by means of the first and second electric heaters 132 and 146 is introduced into the condensation chamber 150, condensed and liquefied at an upper portion of the condensation chamber 150, caused to flow down again by gravity to precipitate in the recovery container 152 arranged at the lower bottom surface of the condensation chamber 150, and recovered in the form of a refined salt.

In this case, a third electric heater 154 and a fourth electric heater 156 configured to heat an inner part of the condensation chamber 150 under different temperature conditions are installed at upper and lower portions of a circumferential sidewall of the condensation chamber 150, respectively.

Here, the heating of the inner parts of the vaporization chamber 140 and the condensation chamber 150 by the first electric heater 132, the second electric heater 146, the third electric heater 154, and the fourth electric heater 156 may be controlled in sequentially decreasing temperatures so that a temperature gradient in the vaporization chamber 140 and the condensation chamber 150 can be formed to facilitate the flow of salt steam.

Also, the decompression device 170 serves to decompress the inner parts of the vaporization chamber 140 and the condensation chamber 150 to a predetermined pressure to maintain the inner parts of the chambers under a constant reduced pressure upon heating the vaporization chamber 140 and the condensation chamber 150.

In this way, the inner part of the vaporization chamber 140 may remain to be decompressed to a predetermined pressure by means of the decompression device while the waste salt is heated by the first electric heater 132 and the second electric heater 146 to a predetermined temperature at which the waste salt is able to be smoothly vaporized.

In this case, the decompression device 170 includes a vacuum pump 171 mutually coupled to a lower end of the condensation chamber 150 via a connection pipe 176, a filter 174 installed above the connection pipe 176 to filter impurities included in the circulating air, two valves 172 and 173 installed respectively at front and rear portions of the filter 174, and a pressure sensor 175 configured to sense a pressure in the connection pipe 176. When the inner parts of the chambers are in a decompressed state under a predetermined pressure by means of the decompression device 170, the valve 173 arranged at the rear portion of the pressure sensor 175 is closed in a state in which the decompressed state is maintained in the chambers, and an operation of decompression device 170 is suspended to produce conditions for closed systems under a reduced pressure.

In the reaction/distillation apparatus 100, a bottom cover 160 configured to unload the recovery container 152 is switchably installed at a lower end of the condensation chamber 150 having the recovery container 152 disposed therein. In this case, the bottom cover 160 is coupled via a bottom cover opening/closing device 190, which is vertically driven by force acting on a piston of a cylinder, so that the bottom cover opening/closing device 190 can be configured to automatically open and close the bottom cover 160.

In addition, a cooling water circulation passage 180 is formed at the bottom of the condensation chamber 150 having the recovery container 152 arranged therein to circulate cooling water supplied from the outside, preventing a refined salt precipitated in the recovery container 152 from being heated to a predetermined temperature by means of the cooling water circulating through the cooling water circulation passage 180.

Reference numerals 161 and 162, which have yet to be described, represent temperature sensors configured to detect temperatures in upper and lower inner sides of the condensation chamber 150 heated respectively by the third electric heater 154 and the fourth electric heater 156, reference numeral 163 represents a temperature sensor configured to detect a temperature in an inner part of the recovery container 152 in which a refined salt is precipitated, and reference numeral 164 represents a temperature sensor configured to detect a temperature in the bottom of the recovery container 152 cooled by the cooling water.

Hereinafter, processes of the method of separating radioactive nuclides from a waste salt and recovering a refined salt according to the present invention will be described.

Figure 3:
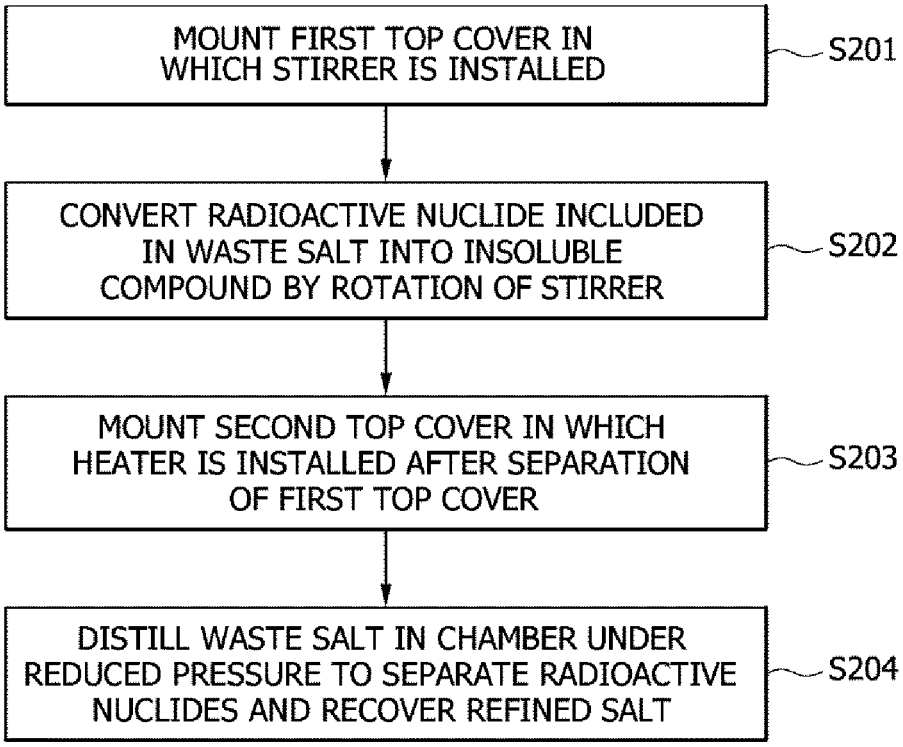
FIG. 3 is a flowchart sequentially illustrating processes of a method of separating radioactive nuclides from a waste salt and recovering a refined salt according to one exemplary embodiment of the present invention.

FIG. 3 is a flowchart sequentially illustrating processes of a method of separating radioactive nuclides from a waste salt and recovering a refined salt according to one exemplary embodiment of the present invention.

Referring to FIG. 3, the method of separating radioactive nuclides from a waste salt and recovering a refined salt according to the present invention includes, first, installing the first top cover 110 provided with the stirrer 116 in the reaction/distillation apparatus 100 (S201), agitating a radioactive nuclide in a waste salt and a chemical additive by rotating the stirrer 116 provided in the first top cover 110 and converting the radioactive nuclides in waste salt into an insoluble compound in the waste salt (S202), detaching the first top cover 110 provided with the stirrer 116 from the reaction/distillation apparatus 100, replaceably mounting the second top cover 130 provided with the heater 132 in the reaction/distillation apparatus 100 (S203) when the chemical conversion reaction is completed, distilling the waste salt under a reduced pressure to separate the radioactive nuclides, and recovering a renewable refined salt (S204).

Operations S201 and S202 are operations of converting the radioactive nuclides into thermally stable forms (an oxide, a phosphate, a sulfate or a carbonate) by injecting a proper amount of chemical additives (an oxidizing agent, a phosphorylating agent, a sulfating agent or a carbonating agent) into the waste salts including the radioactive nuclides.

To convert the radioactive nuclides into the thermally stable forms by injecting the chemical additive into the waste salt as described above, this conversion process may be performed at a predetermined temperature (610 to 650° C. in the case of LiCl, and 450 to 550° C. in the case of LiCl—KCl) at which the waste salt can be present in a molten state. However, since salts are highly volatile, the operating temperature may be controlled so that the operating temperature does not exceed the predetermined temperature.

Here, the radioactive nuclides in the waste salt are dissolved in the form of a chloride, but at least a predetermined equivalent amount of a chemical additive should be added to convert the radioactive nuclides into thermally stable forms. In this case, the equivalent amount of the added chemical additive may be different according to the kind of chemical additives and the nuclides. Therefore, the highest equivalent amount of the chemical additive required for chemical conversion may be calculated in consideration of all the radioactive nuclides, and almost all the radioactive nuclides in the form of a chloride may be converted into the thermally stable forms only when necessary chemical additives should be added.

To perform this chemical conversion reaction effectively, agitation may be performed for a predetermined period of time to allow the radioactive nuclides to effectively react with the chemical additives in the waste salt after addition of the chemical additives. In this case, the stirrer 116 used to agitate the waste salt may be adopted in the form of an impeller 114 having four pitched blades in consideration of uniform mixing in a solid-liquid reaction.

In addition, two baffles 114 may be installed near the wall of the reaction container 142 so as to enhance stability and agitation efficiency in agitating a medium (i.e., a molten salt) as described above. When the chemical reaction of the waste salt using the stirrer 116 is completed, an upward/downward driving device 120 may be installed to unload the stirrer 116 and the baffle 115 from the medium. The agitation rate and the agitation time required to agitate the waste salt using the stirrer 116 may vary according to the reaction capacity, but an effective conversion rate of the radioactive nuclides may be obtained when the agitation is performed for at least 2 hours.

Meanwhile, since the radioactive nuclide compound (an oxide, a phosphate, a sulfate or a carbonate) produced in the waste salt through the above-described chemical conversion reaction is melted or precipitated in the waste salt, it is difficult to separate only the radioactive nuclide compound, and it is necessary to completely separate the radioactive nuclide compound from the waste salt so as to promote ease of preparing a stable solid form for minimizing and finally disposing of a radioactive waste and a handling property for recycling the separated nuclides.

Operations S203 and S204 are operations of separating the radioactive nuclides and recovering a renewable refined salt by distilling the waste salt under a reduced pressure using the second top cover 130 provided with the first electric heater 132 when the chemical conversion reaction of the waste salt is completed as in Operations S201 and S202.

In this case, when the chemical conversion reaction of the waste salt after Operations S201 and S202 is completed, the waste salt should be cooled to a temperature of 200° C. or lower to smoothly perform replacement of the top covers 110 and 130 and handling of the reaction container 142.

The radioactive nuclide compound produced through the chemical conversion reaction as described above is thermally stable. However, the salts (LiCl and LiCl—KCl) are more volatile than the radioactive nuclide compound. That is, the radioactive nuclide compound and the salts may be separated through a vacuum distillation method using physical properties of the highly volatile salts. In this case, the vacuum distillation method has an advantage in that no additional waste is produced. In particular, distillation of such salts under a reduced pressure has an advantage in that purity of the recovered refined salt may be improved, and no additional waste is produced.

To cool the reaction container 142 to 200° C. or lower, separate the radioactive nuclide compound and the salts through distillation under a reduced pressure and recover a renewable refined salt when the chemical conversion reaction in Operations S201 and S202 is completed, conditions of constant reduced pressure in the chambers should be produced, followed by causing an increase in temperature at which the salts are volatile.

The above-described vacuum distillation is a method of reducing an operating temperature for vaporization by vaporizing a target compound under constant reduced pressure conditions. In the case of such a vacuum distillation method, the vapor pressure of the target compound according to a temperature is important data used to set the operating conditions. The vapor pressure of a salt (LiCl or LiCl—KCl) according to a temperature may be calculated based on the context disclosed in a non-patent document: Handbook of Vapor Pressure (C. L. YAWS, Handbook of Vapor Pressure, Volume 4, Inorganic Compounds and Elements, Gulf Publishing, Houston, Tex., USA, 1995), p 360. The results are listed in the following Tables 1 and 2.

TABLE 1

Vapor pressure of LiCl according to temperature

| Temperature (° C.) | 600 | 650 | 700 | 750 | 800 | 850 | 900 |
|---|---|---|---|---|---|---|---|
| Pressure (Torr) | 0.009 | 0.047 | 0.175 | 0.526 | 1.348 | 3.077 | 6.445 |

TABLE 2

Vapor pressure of LiCl—KCl eutectic salt (LiCl:KCl = 44.2 wt %:55.8 wt %) according to temperature

| Temperature (° C.) | 600 | 650 | 700 | 750 | 800 | 850 | 900 |
|---|---|---|---|---|---|---|---|
| Pressure (Torr) | 0.007 | 0.033 | 0.119 | 0.359 | 0.945 | 2.232 | 4.847 |

The distillation of the salts under a reduced pressure is performed using the reaction/distillation apparatus 100 composed of one single apparatus including a vaporization chamber 140, a condensation chamber 150 and a decompression device 170, and the shapes of the salts are as shown in FIGS. 1 and 2.

To separate the radioactive nuclide compound and the salts through the distillation of the salts under a reduced pressure, the operating temperature of the vaporization chamber 140 and the pressure conditions in the reaction/distillation apparatus 100 are determined based on the vapor pressure of the LiCl or LiCl—KCl eutectic salt listed in Tables 1 and 2, and the details of operating procedures for distillation of salts under a reduced pressure are as follows.

First, an inner part of the reaction/distillation apparatus 100 is decompressed to a predetermined pressure using the decompression device 170 while heating the vaporization chamber 140 to a predetermined temperature, and remains in a decompressed state. In this case, the predetermined temperature refers to a temperature at which a salt introduced into the vaporization chamber 140 is not vaporized under a reduced pressure. In addition, an inner part of the condensation chamber 150 is heated to a temperature lower than that of the vaporization chamber 140 to form a temperature gradient between the vaporization chamber 140 and the condensation chamber 150. In this case, the predetermined pressure should be set to 0.005 Torr or less in consideration of maintenance of a hermetic state of an apparatus and hence reduced pressure conditions for vaporization of salts.

When the reduced pressure conditions at a predetermined temperature and a predetermined pressure are produced in the vaporization chamber 140 as described above, the rear portion of the pressure sensor 175 as shown in FIG. 1 is closed while maintaining the reduced pressure conditions, and an operation of the decompression device 170 is suspended to produce conditions for closed systems in a state in which inner parts of the chambers in the reaction/distillation apparatus 100 are maintained under a reduced pressure. Then, the vaporization chamber 140 in which the salts are present is heated to a temperature (850° C. or higher) at which the salts are able to be smoothly vaporized, and the condensation chamber 150 is heated to a temperature lower than this temperature range so that the vaporized salt (salt steam) can be allowed to rapidly move from the vaporization chamber 140 to the condensation chamber 150 by means of a temperature gradient.

In this case, the temperature in the bottom of the recovery container 152 is possibly controlled to exceed 50° C. so as to promote liquefaction and gravity precipitation of the salt vapor transferred to the condensation chamber 150, and cooling of the salt vapor into a solid state, and easily separate the recovered salt in a solid state precipitated in the recovery container 152.

When the distillation of the salts under a reduced pressure is completed in this way, salts are hardly present in the remaining nuclide compound. In this case, the nuclide compound is in a thermally stable form, and thus easily subjected to solidification for final disposal. Also, the recovered salt is discharged in a solid phase having the same shape as the inner part of the recovery container, and can be recycled as a high-purity refined salt including almost no nuclides.

As described above, the method of separating radioactive nuclides from a waste salt and recovering a refined salt according to the present invention can be useful in highly curtailing the economic costs in construction and use of facilities by performing the conventional processes, which have heretofore been performed in a plurality of processes and apparatuses, in two processes (i.e., a process of converting radioactive nuclides in a waste salt into an insoluble compound, and a process of separating the radioactive nuclide through distillation of salts under a reduced pressure and recovering a renewable refined salt) in a single apparatus (i.e., a reaction/distillation apparatus), and highly improving operating efficiency by highly reducing (50% or more) the process operating time.

Also, since there are no processes of separating a solid salt in the reaction container and separating a precipitate layer like the conventional processes, the contamination of refined salt produced in these processes and the loss of salts can be prevented, fine salt particles necessary to be further processed are not formed, unlike the conventional processes, and the recovery ratio (99% or more) and purity (nuclide separation efficiency of greater than 99.9%) of salts can be enhanced. Also, since the finally recovered salt is easily separated in the recovery container and its entire operation/handling is simply performed, applicability in remote operation facilities for disposal of radioactive waste can be highly improved.

Hereinafter, the method of separating radioactive nuclides from a waste salt and recovering a refined salt according to the present invention will be described with reference to the following Examples. However, it should be understood that the following Examples are given by way of illustration of the present invention only, and are not intended to limit the scope of the present invention.

EXAMPLE

Separation of Rare-earth Nuclides (Y, La, Ce, Pr, Nd, Sm, Eu, and Gd) from LiCl—KCl Eutectic Salt and Regeneration of LiCl—KCl Eutectic Salt According to the Present Invention First Operation of Converting Rare-Earth Nuclides In Eutectic Waste Salt into Insoluble Compound (Phosphide) in Eutectic Waste Salt using First Top Cover 110 Provided with Impeller 114

A simulated LiCl—KCl eutectic waste salt ingot including 2.5 kg of a LiCl—KCl eutectic salt and 125 g of rare-earth chlorides ($YCl_3$, $LaCl_3$, $CeCl_3$, $PrCl_3$, $NdCl_3$, $SmCl_3$, $EuCl_3$, and $GdCl_3$) was put into a reaction container 142, and one equivalent amount of a $Li_3PO_4$—$K_3PO_4$ mixed phosphorylating agent (at the same mixing ratio as a weight ratio of Li and K in the eutectic salt) was added to an upper portion of the reaction container 142. Then, the resulting mixture was charged into an apparatus. When a stirrer (an impeller) was positioned at the highest position, a first top cover 110 was closed, heated to 450° C. with respect to a temperature of the eutectic salt, and then maintained at 450° C. After a lapse of predetermined time, when the simulated eutectic waste salt was converted into a liquid phase, the stirrer 116 was lowered, and the impeller 114 was rotated at approximately 300 rpm. Agitation was performed for approximately one hour in consideration of a complete chemical conversion reaction. When the agitation was completed, a temperature in the vaporization chamber 140 was cooled to approximately 200° C. in a state in which the stirrer 116 was allowed to move to the highest end of the first top cover 110 (the first top cover was in a closed state).

Second Operation of Separating Radioactive Nuclides and Recovering Renewable Refined Salt by Distilling Salts Under a Reduced Pressure Using Second Top Cover 130 Provided with Electric Heater After the temperature in the apparatus was cooled to 200° C. in the first operation, the reaction container 142 was unloaded, the first top cover 110 was replaced with a second top cover 130 provided with an electric heater, and the reaction container 142 was then put on a container holder 144, and loaded into the apparatus. After loading the reaction container 142, a first electric heater 132 and a second electric heater 146 disposed at upper and lower sides of the vaporization chamber 140 were heated to 500° C., and maintained at 500° C. Also, an inner part of the apparatus was decompressed to a pressure of approximately 0.003 Torr using a decompression device 170.

Next, when the reduced pressure state was maintained at a set temperature, a valve 173 arranged upstream from the decompression device 170 was closed, and an operation of the decompression device 170 was suspended to control the apparatus so that closed systems in the apparatus could be operated. Thereafter, the first and second electric heaters 132 and 146 disposed at the vaporization chamber 140 were heated to approximately 960° C. (about 900° C. based on an inner part of the chamber), and the third electric heater 154 disposed at an upper portion of the condensation chamber 150 was heated to approximately 700° C. In this case, the heating rate was approximately 10° C./min. During heating of the apparatus, cooling water was also circulated to prevent a temperature of the bottom of the recovery container 152 from exceeding 50° C.

Almost all the eutectic salt (99.9% or more) which was present at a content of 2.5 kg in the reaction container 142 was vaporized in this procedure. Then, the vaporized salt was condensed along a temperature gradient formed in the apparatus, and precipitated in the recovery container 152. A time required for condensation and precipitation was approximately 2 hours based on a point of time at which the electric heater reached a set temperature.

Figure 4:
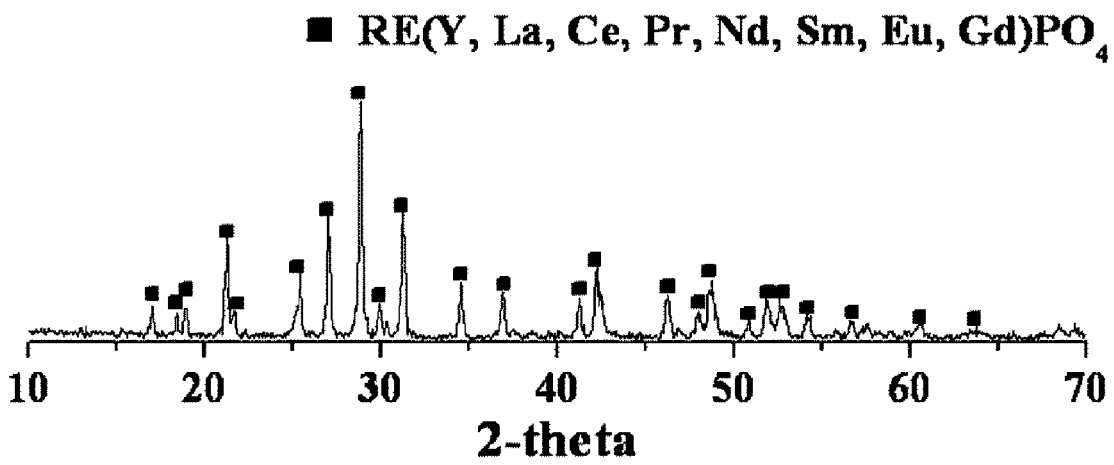
FIG. 4 is a graph illustrating residual fractions of the rare-earth nuclide compounds obtained through the processes of the method of separating radioactive nuclides from a LiCl—KCl eutectic salt and recovering a refined salt according to one exemplary embodiment of the present invention, as observed from X-ray diffraction analysis.

Subsequently, after the distillation of the eutectic salt was confirmed to be completed, the apparatus was cooled to room temperature. Thereafter, an inner part of the apparatus cooled to room temperature was compressed to atmospheric pressure, and the second top cover 130 was then opened to unload a remaining distillate. From X-ray diffraction analysis (see FIG. 4), it was confirmed that all the rare-earth chlorides were converted into phosphates. Also, it was revealed that the eutectic salt in the remaining distillate was present at a content of less than 0.1%. Then, the bottom cover 160 was opened to recover a refined salt remaining in the recovery container 152, and a concentration of the rare-earth nuclides in the refined salt was assayed to determine separation efficiency of the rare-earth nuclide compound. As a result, it could be seen that the separation efficiency of the rare-earth nuclide compound was greater than or equal to 99.9%.

As described above, the method of separating radioactive nuclides from a waste salt and recovering a refined salt according to the present invention can be useful in highly improving economic feasibility as a radioactive waste disposal technique and applicability in a remote operation facility since the method can be used to maximize process efficiency and operating efficiency of technology of regenerating a waste salt produced during a pyrochemical process of used nuclear fuel, separate the radioactive nuclides in a form in which the radioactive nuclides are easily solidified under a condition in which the loss of salts is minimized, simplify apparatuses and processes, and improve nuclide separation efficiency and purity of a recovered salt.

According to the present invention configured thus, the economic costs in construction and use of facilities can be highly curtailed by simplifying apparatuses and processes to perform the conventional processes, which have heretofore been performed in a plurality of processes and apparatuses (two processes on LiCl waste salt in two apparatuses/four processes on LiCl—KCl eutectic waste salt in four apparatuses) for separating radioactive nuclides from a waste salt and recovering a refined salt, in two processes in a single apparatus, and operating efficiency may be highly improved by highly reducing the process operating time.

Also, since there are no additional processes of separating a solid salt in a reaction container and separating a precipitate layer as known in the prior art, the loss of salts, the contamination of refined salt, and formation of fine particles necessary to be further processed, all of which are problematic in the conventional processes, are not caused, thereby maximizing process efficiency and operating efficiency of technology of regenerating a waste salt produced during a pyrochemical process of used nuclear fuel, and improving a recovery ratio and purity of salts. Finally, applicability and utility in a remote operation facility for disposal of a radioactive waste can be highly improved since the recovered salt can be easily separated in the recovery container and the entire operation/handling is simpler than the conventional processes.

It will be apparent to those skilled in the art that various modifications can be made to the above-described exemplary embodiments of the present invention without departing from the spirit or scope of the invention. Thus, it is intended that the present invention covers all such modifications provided they come within the scope of the appended claims and their equivalents.

What is claimed is:

1. An apparatus for separating radioactive nuclides from a waste salt and recovering a refined salt, comprising:

a vaporization chamber having a reaction container installed therein for accommodating a waste salt;

a first top cover provided with a stirrer configured to agitate the waste salt accommodated in the reaction container of the vaporization chamber;

a second top cover provided with a first electric heater configured to distill the waste salt under a reduced pressure and mutually replaceable with the first top cover provided with the stirrer when a chemical conversion reaction of the waste salt using the stirrer is completed;

a condensation chamber in which salt steam produced by heating the vaporization chamber is condensed and liquefied;

a decompression device configured to decompress inner parts of the vaporization chamber and the condensation chamber to a predetermined pressure;

a recovery container which is disposed at the bottom of the condensation chamber and in which the salt vapor liquefied at the condensation chamber precipitates to be recovered; and a bottom cover switchably installed at the bottom of the condensation chamber to unload the recovery container.

2. The apparatus of claim 1, wherein a baffle coupled to the stirrer is installed in the reaction container to be adjacent to an inner wall of the reaction container.

3. The apparatus of claim 2, further comprising an upward/downward driving device driven to lift the stirrer and the baffle upward at the same time.

4. The apparatus of claim 1, further comprising a top cover opening/closing device configured to automatically open and close the first top cover or the second top cover.

5. The apparatus of claim 1, further comprising a bottom cover opening/closing device configured to automatically open and close the bottom cover.

6. The apparatus of claim 1, further comprising:

a second electric heater configured to heat the vaporization chamber; and a third electric heater and a fourth electric heater configured to heat upper and lower portions of the condensation chamber, respectively, wherein the heating by the second electric heater, the third electric heater and the fourth electric heater is controlled in sequentially decreasing temperatures so that a temperature gradient in the vaporization chamber and the condensation chamber is formed to facilitate the flow of salt vapor.

7. The apparatus of claim 6, wherein the vaporization chamber is decompressed to a predetermined pressure by means of the decompression device while the waste salt is heated by the second electric heater to a predetermined temperature at which the waste salt is able to be smoothly vaporized.

8. The apparatus of claim 1, wherein a cooling water circulation passage is formed at the bottom of the recovery container.

* * * * *